US009194214B2

(12) United States Patent
Schneider

(10) Patent No.: US 9,194,214 B2
(45) Date of Patent: Nov. 24, 2015

(54) METHOD AND SYSTEM FOR CONTROLLING WELLBORE PRODUCTION TEMPERATURE

(71) Applicant: Marvin J. Schneider, League City, TX (US)

(72) Inventor: Marvin J. Schneider, League City, TX (US)

(73) Assignee: WORLD ENERGY SYSTEMS INCORPORATED, Fort Worth, TX (US)

( * ) Notice: Subject to any disclaimer, the term of this patent is extended or adjusted under 35 U.S.C. 154(b) by 376 days.

(21) Appl. No.: 13/749,288

(22) Filed: Jan. 24, 2013

(65) Prior Publication Data

US 2013/0192834 A1 Aug. 1, 2013

Related U.S. Application Data

(60) Provisional application No. 61/593,122, filed on Jan. 31, 2012.

(51) Int. Cl.
*E21B 36/00* (2006.01)

(52) U.S. Cl.
CPC ..... *E21B 36/001* (2013.01); *E21B 36/003* (2013.01)

(58) Field of Classification Search
CPC ... E21B 36/001; E21B 47/001; E21B 36/003; E21B 36/00; E21B 43/16
See application file for complete search history.

(56) References Cited

U.S. PATENT DOCUMENTS

| | | | | |
|---|---|---|---|---|
| 3,357,490 | A * | 12/1967 | Holmes | 166/53 |
| 4,125,289 | A | 11/1978 | Huff et al. | |
| 2010/0089585 | A1 | 4/2010 | Kaminsky | |

FOREIGN PATENT DOCUMENTS

| | | | |
|---|---|---|---|
| RU | 2170810 | C2 | 7/2001 |
| RU | 2187630 | C2 | 8/2002 |
| RU | 2187631 | C2 | 8/2002 |
| SU | 335370 | | 4/1972 |
| SU | 426028 | A1 | 4/1974 |

OTHER PUBLICATIONS

Canadian Office Action for Canadian Patent Applicaton No. 2,803,428, dated Oct. 8, 2014.

* cited by examiner

*Primary Examiner* — Yong-Suk (Philip) Ro
(74) *Attorney, Agent, or Firm* — Patterson & Sheridan, L.L.P.

(57) ABSTRACT

A method and system of controlling the temperature of fluids produced from a reservoir to prevent overheating of an adjacent geological formation. A cooling fluid is supplied through an annulus formed between a production tubing and a production casing, which are in fluid communication with the reservoir. The cooling fluid is mixed with the reservoir fluid, and the fluids are produced through the production tubing. The temperature of the produced fluids is controlled or reduced by heat exchange with the cooling fluid supplied through the annulus to prevent excessive heat dissipation to the geological formation.

20 Claims, 1 Drawing Sheet

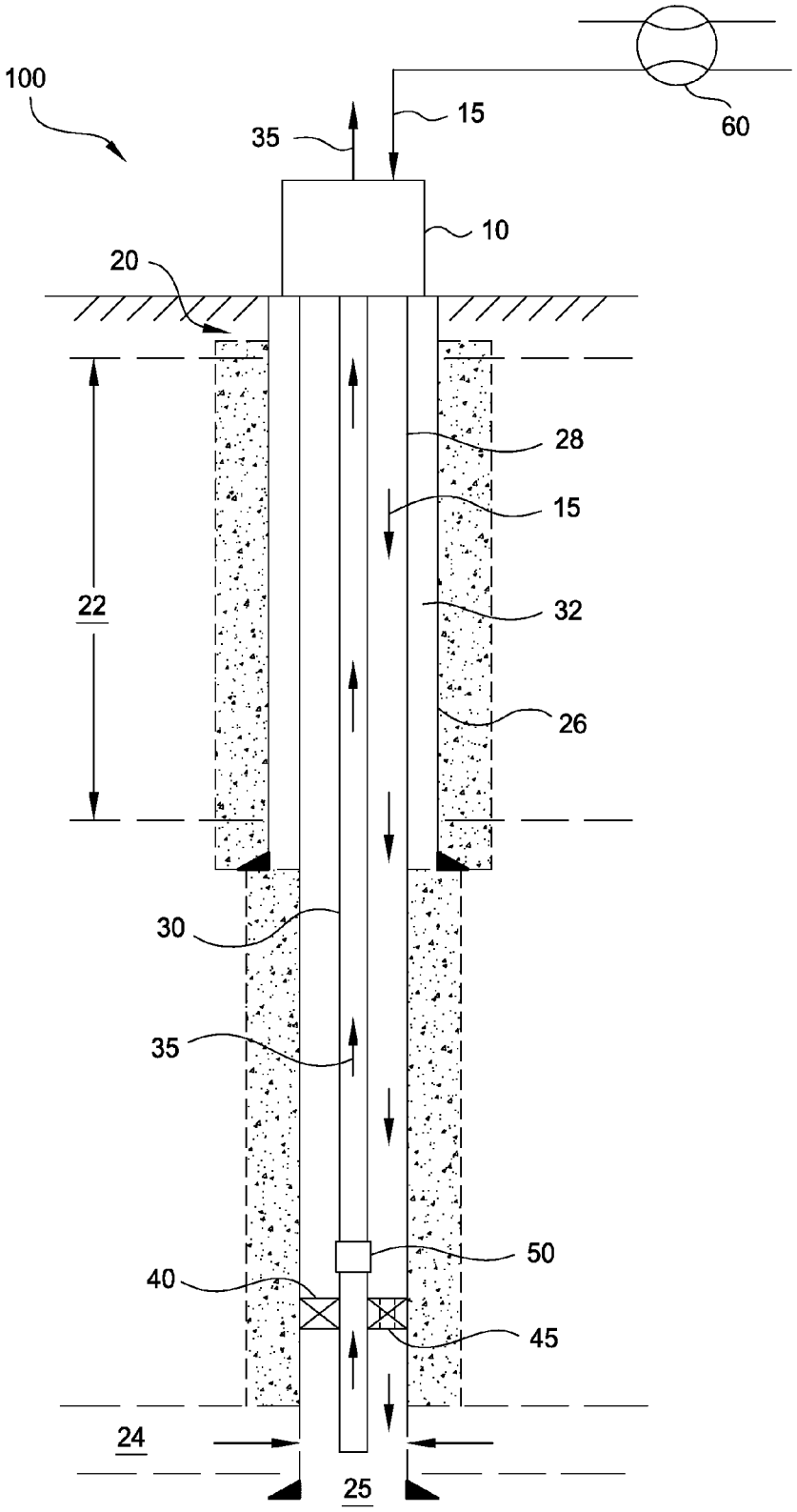
100
35
15
60
10
20
28
15
22
32
26
30
35
50
40
45
24
25

METHOD AND SYSTEM FOR CONTROLLING WELLBORE PRODUCTION TEMPERATURE

BACKGROUND OF THE INVENTION

1. Field of the Invention

Embodiments of the invention relate to methods and systems for controlling and managing the production temperature of hydrocarbons and other fluids being produced through a wellbore designed to bring the fluids to the earth's surface from a subsurface producing zone or formation.

2. Description of the Related Art

It is common practice to drill one or more wellbores into the earth for the search and production of hydrocarbons and other similar fluids located in subsurface reservoirs. There are situations where the produced fluids are so relatively hot that there is a danger of overheating the geologic formations overlying the production zone, such as a hydrate or a permafrost layer overlying a hydrocarbon reservoir. Overheating of a permafrost layer may for example cause the permafrost to expand or thaw and thereby cause significant wellbore stability issues. Disassociation of a hydrate zone may cause other problems as well. Where the danger exists, current practice is to either limit operations to instances where the produced fluids are naturally low enough in temperature to not cause a problem, or to rely on natural cooling up a lower wellbore which is deep enough and has enough length to allow sufficient natural cooling before the produced fluids reach the danger zone.

As a result, a significant quantity of hydrocarbon, mineral or other resources have remained undeveloped because of a lack of enabling technology. This is because current producing methods do not provide adequate temperature protection, control, and management. There is a need, therefore, for new methods and systems of overcoming such limitations.

SUMMARY OF THE INVENTION

Embodiments of the invention include a method of controlling wellbore production temperature, comprising supplying a cooling fluid through an annulus formed between a production tubing and a production casing, wherein the production tubing is in fluid communication with a subsurface reservoir; mixing the cooling fluid with a reservoir fluid from the subsurface reservoir; producing fluid through the production tubing; and controlling a temperature of fluid flowing through the production tubing using the cooling fluid supplied through the annulus.

Embodiments of the invention include a method of controlling wellbore production temperature, comprising supplying a cooling fluid through an annulus formed between a production tubing and a production casing, wherein the production casing extends through a geological formation overlying a subsurface reservoir; producing fluid from the subsurface reservoir through the production tubing; and preventing overheating of the geological formation by using the cooling fluid to reduce a temperature of the fluid produced through the production tubing.

Embodiments of the invention include a wellbore production system, comprising a wellhead; a production tubing in communication with the wellhead and operable to produce fluids from a subsurface reservoir; a production casing in communication with the wellhead, wherein the wellhead is operable to supply a cooling fluid through an annulus formed between the production tubing and the production casing while producing fluids through the production casing, and wherein the cooling fluid is supplied to a mixing zone that is in fluid communication with the subsurface reservoir; and an insulating layer surrounding the production casing.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a schematic view of a wellbore production system according to one embodiment.

DETAILED DESCRIPTION

Embodiments of the invention can be applied to any production well with a producing tubular string extending down through a cased wellbore. The producing tubular string may utilize a length of insulated tubing (vacuum insulated tubing or other design) installed, usually but not necessarily, in the upper section of the producing tubular string. A down flowing cooling fluid or fluids may be introduced into the wellbore annulus or annuluses at the top of the production well.

The wellbore production system operates by introducing the cooling fluid into a well annulus, and using heat exchange between the down flowing cooling stream and the up flowing production stream, as well as using heat exchange between the down flowing cooling stream and the adjacent geological formations, via heat transfer through the casing and cement. At the bottom of the well, the down flowing fluids are mixed with the net produced fluids, and the total fluids are directed up the tubular string. The wellbore production system may or may not include either a packer or a fluid lift mechanism.

The cooling fluid may comprise one or more of the following: carbon compounds, carbon dioxide, nitrogen, hydrocarbons, water, low-melting point salts, and glycols. The cooling fluid may or may not be miscible with the wellbore fluids. The cooling fluid may comprise a recovered fluid (liquid or gas) that has been produced from the reservoir. During operation, the cooling fluid may be separated at the surface from the produced wellbore fluid stream, and then may be cooled and/or recycled for reuse as a cooling fluid again. One or more component fluids from the produced wellbore fluid stream may be separated at the surface and then may be used as a cooling fluid. The produced wellbore fluid stream may be sent through a separation device that utilizes, among others, physical/gravity, distillation, and/or membrane separation processes to separate one or more components from the wellbore fluid stream, which may be used as a cooling fluid.

The temperature of the cooling fluid to be utilized is dependent on the physical parameters of the wellbore and related systems, e.g. well depth, wellbore design, fluid characteristics, geological formation characteristics, heat transfer characteristics, insulated tubing performance, operating fluid flow rates and temperatures, and other pertinent parameters.

By proper selection of layout, dimensions, thermal resistances, cooling fluid and other parameters for the design of the wellbore and related systems, the production well heat flows and thus the temperatures of the outer wellbore can be managed such that the outer wellbore temperature across from the geologic danger zone does not exceed safe limits. The buffering provided by the arrangement will limit the amount of heat flow into the geological danger zone opposite the upper or intermediate wellbore containing the insulated tubing, while safely directing the remaining heat flow entering the production well either into the geologic formations opposite the other, non-insulated section(s) of the wellbore, or out the wellhead with the total produced fluids.

Temperature measurement may be provided at the wellhead for both the up-flowing and down-flowing fluid streams. Additionally, in some instances, it may be appropriate to install downhole temperature measurement devices at intervals of the casing opposite the geologic danger zone. Temperature measurement devices may be located at various intervals along the length of one or more casings and/or the wellbore to obtain temperature measurements of the fluids flowing therethrough, of the casing itself or of the adjacent geologic formations. Interpretation of the temperature data obtained will enable satisfactory operating control for maintaining temperatures opposite the geologic danger zone at safe levels.

FIG. 1 illustrates a wellbore production system 100 according to one embodiment. The wellbore production system 100 includes a wellhead 10 for controlling the recovery of fluids from a wellbore 20 that is drilled through a subsurface reservoir 24. The wellbore 20 also intersects a geological formation 22, such as a hydrate layer or a permafrost layer, disposed above the reservoir 24. The geological formation 22 may be a zone or layer of earthen formation intersected by the wellbore 20 that includes a temperature less than that of the remaining earthen formation (or other zones or layers) intersected by the wellbore 20. The wellbore production system 100 is operable to manage the temperature of fluids, such as hydrocarbons, recovered from the reservoir 24 to prevent overheating of the geological formation 22.

The wellbore 20 may be supported by an outer production casing 26 and an inner production casing 28 that extend through the geological formation 22. The outer and/or inner production casing 26, 28 may be cemented (and/or secured using a similar refractory material) in the wellbore 20 to provide structural and sealing integrity. A cement layer between the outer production casing 26 and the geological formation 22 may function as a thermal insulating layer to help minimize or reduce any heat dissipation from the wellbore 20 to the geological formation 22. The wellhead 10 may control fluid flow into and out of the outer and inner production casings 26, 28.

A production tubing 30 extends from the wellhead 10, through the geological formation 22, and into an area adjacent the reservoir 24. A portion or section of the production tubing 30 may be formed from insulated tubing, such as vacuum insulated tubing, while the remaining or other portions of the production tubing 30 may be formed from non-insulated tubing. The production tubing 30 is surrounded by the inner production casing 28. The inner production casing 28 may be perforated to allow fluids from the reservoir 24 to flow into the inner production casing 28. Fluids from the reservoir 24 may be recovered to the surface through the production tubing 30. A sealing member 40, such as a packer, may be used to secure and seal the production tubing 30 within the inner production casing 28. A fluid lift member 50, such as a pump, may be used to pump fluids from the reservoir 24 to the surface through the production tubing 30.

To help control the temperature of fluids 35 recovered up through the production tubing 30, a cooling fluid 15 may be simultaneously supplied from the wellhead 10 down through the annulus between the production tubing 30 and the inner production casing 28. The cooling fluid 15 may be supplied at a temperature that is less than the temperature of the fluids 35 flowing through the production tubing 30. The cooling fluid 15 may flow through the bore of the inner production casing 28 and through a flow path which may contain a check valve 45 coupled to the sealing member 40. The check valve 45 is operable to permit fluid flow in one direction while preventing fluid flow in the opposite direction. The cooling fluid 15 may mix with the reservoir 24 fluids in a mixing zone 25 (adjacent to the reservoir 24 and/or within the lower end of the production casing 28) to form a mixed or combined fluid 35. The cooling fluid 15 may be miscible or immiscible with the reservoir 24 fluids. The mixed or combined fluids 35 may then be recovered to the surface through the production tubing 30. In one embodiment, the fluid 35 may comprise cooling fluid 15, reservoir 24 fluid, and/or a combination of cooling and reservoir fluid.

The cooling fluid 15 may reduce the temperature of the fluids 35 flowing through the production tubing 30 to thereby minimize or reduce the heat dissipation to the geological formation 22. In one embodiment, the cooling fluid 15 may also reduce the temperature of the geological formation 22. In one embodiment, the temperature of the cooling fluid 15 may be reduced by the temperature of the geological formation 22.

Heat exchange between the cooling fluid 15, the production fluids 35, and/or the geological formation 22 is managed and controlled to prevent heating of the geological formation 22 to a temperature above an acceptable temperature range. In one embodiment, the heat exchange may be used to maintain the temperature of the geological formation 22 within an acceptable temperature range. In one embodiment, the heat exchange may be used to prevent cooling of the geological formation 22 to a temperature below an acceptable temperature range.

A heat exchanger 60 may be used to reduce the temperature of the cooling fluid 15 before it is supplied down hole. A diluent fluid may be added to or substituted for the cooling fluid 15 for the purpose of mixing with the reservoir 24 fluids and improving the fluid handling characteristics (e.g. reduce viscosity) of the fluid 35 stream recovered to the surface. The temperature of the cooling fluid 15 may depend on the physical parameters of the wellbore 20 and/or the wellbore production system 100, including but not limited to well depth, wellbore design, fluid characteristics, geological formation characteristics, heat transfer characteristics, insulated tubing performance, operating fluid flow rates and temperatures. By proper selection of layout, dimensions, thermal resistances, cooling fluid and other parameters for the design of the wellbore 20 and/or the wellbore production system 100, that are consistent with the flow rate at which the production fluids 35 are recovered through the production tubing 30, the temperatures of the wellbore 20 can be managed such that the temperature across the geological formation 22 does not exceed safe limits. The wellbore production system 100 is operable to limit the amount of heat flow or transfer from the produced fluids 35 into the geological formation 22, while safely directing the remaining heat flow or transfer of the produced fluids 35 either into the geological formations below the danger zone, the danger zone illustrated as the geological formation 22 for example, and/or out of the wellhead 10.

In one embodiment, an annulus 32 between the inner production casing 28 and the outer production casing 26 may be filled with gelled brine or other insulating/thermal resistant material to minimize or reduce heat dissipation to the adjacent geological formation 22. In one embodiment, the annulus 32 or another annulus formed between the production tubing 30 and the geological formation 22 may be filled with nitrogen or other insulating/thermal resistant fluid to minimize or reduce heat dissipation to the adjacent geological formation 22. In one embodiment, a tubing string may be run from the wellhead 10 to a location near the bottom of the annulus 32 to allow for the supply and circulation of nitrogen gas through the annulus 32.

In one embodiment, a "core-flow" process may be used with the embodiments discussed herein to control and manage (e.g. cool) the temperature of the stream of production fluid 35. Core-flow may include the pumping of a greater viscosity liquid through a core that is surrounded by a lesser viscosity liquid. The greater viscosity liquid may include hydrocarbons or other wellbore produced fluids, such as the production fluids 35. The lesser viscosity liquid may include the cooling fluid 15, such as water. The core-flow may be established by injecting the less viscous liquid, such as water, around the greater viscous liquid while it is being pumped through a tubular. For example, water may be injected into the production tubing 30 to form a surrounding cooling layer about the core stream of production fluids 35 while being pumped to the surface. The lesser viscosity fluid may be injected into the production tubing 30 at any location along its length, including, but not limited, to above or below the pump 50 and/or above or below the sealing member 45.

In one embodiment, one or more temperature measurement devices, such as thermocouples or other types of sensors, may be disposed at the wellhead 10 and/or at one or more locations along the length of the casing/tubing 26, 28, 30 for measuring and monitoring the wellbore 20 temperatures. In one embodiment, the temperature of the fluids 15, 35 may be measured and monitored as they are flowing into and out of the wellbore 20. The measured temperature data may assist in optimally controlling and maintaining of the wellbore 20 temperatures adjacent the geological formation 22.

Embodiments of the invention may be used for different but similar purpose applications where heat loss from a wellbore needs to be limited. Embodiments of the invention are applicable to both injection wells and production wells installed in an offshore environment from an offshore platform or other floating drilling and producing system. Embodiments of the invention are configurable by altering the layout of the systems for deeper geological formations not extending all the way to the surface.

While the foregoing is directed to embodiments of the invention, other and further embodiments of the invention may be devised without departing from the basic scope thereof, and the scope thereof is determined by the claims that follow.

The invention claimed is:

1. A method of controlling wellbore production temperature, comprising:

supplying a cooling fluid through a first annulus formed between a production tubing and an inner production casing, wherein the production tubing is in fluid communication with a subsurface reservoir;

providing a thermal resistant layer within a second annulus formed between the inner production casing and an outer production casing;

mixing the cooling fluid with a reservoir fluid from the subsurface reservoir;

producing fluid through the production tubing; and controlling a temperature of fluid flowing through the production tubing using the cooling fluid supplied through the first annulus.

2. The method of claim 1, further comprising reducing the temperature of fluid flowing through the production tubing using the cooling fluid.

3. The method of claim 1, further comprising supplying the cooling fluid through the first annulus at a temperature that is less that the temperature of fluid flowing through the production tubing.

4. The method of claim 1, wherein the inner and outer production casings extends through a geological formation, and further comprising providing an insulating cement layer between the inner and outer production casings and the geological formation.

5. The method of claim 1, wherein the cooling fluid comprises at least one of carbon compound, carbon dioxide, nitrogen, hydrocarbons, water, low-melting point salts, and glycols.

6. The method of claim 1, further comprising supplying a diluent fluid with the cooling fluid through the first annulus, and mixing the diluent fluid with the reservoir fluid.

7. The method of claim 1, wherein the fluid produced through the production tubing includes the cooling fluid and the reservoir fluid.

8. The method of claim 1, wherein the thermal resistant layer includes gelled brine, nitrogen or other insulating fluid or material.

9. The method of claim 1, further comprising pumping fluid through the production tubing while injecting a less viscous fluid through the production tubing to surround the pumped fluid.

10. The method of claim 1, further comprising separating a fluid from the fluid produced from the production tubing, and supplying the separated fluid through the first annulus as the cooling fluid.

11. A method of controlling wellbore production temperature, comprising:

supplying a cooling fluid through a first annulus formed between a production tubing and an inner production casing, wherein the inner production casing extends through a geological formation overlying a subsurface reservoir;

providing a thermal insulating layer within a second annulus formed between the inner production casing and an outer production casing;

producing fluid from the subsurface reservoir through the production tubing; and preventing overheating of the geological formation by using the cooling fluid to reduce a temperature of the fluid produced through the production tubing.

12. The method of claim 11, further comprising insulating the geological formation from heat dissipated by the fluid produced through the production tubing using the thermal insulating layer, wherein the thermal insulating layer includes gelled brine, nitrogen, or other insulating fluid or material.

13. The method of claim 11, wherein the cooling fluid comprises at least one of carbon compounds, carbon dioxide, nitrogen, hydrocarbons, water, low-melting point salts, and glycols.

14. The method of claim 11, further comprising mixing the cooling fluid with the fluid produced from the subsurface reservoir.

15. The method of claim 14, further comprising supplying a diluent fluid with the cooling fluid to reduce the viscosity of the fluid produced from the subsurface reservoir.

16. The method of claim 14, wherein the fluid produced through the production tubing includes the cooling fluid and the fluid from the subsurface reservoir.

17. The method of claim 11, further comprising separating a fluid from the fluid produced through the production tubing, and supplying the separated fluid through the first annulus as the cooling fluid.

18. A wellbore production system, comprising:

a wellhead;

a production tubing in communication with the wellhead and operable to produced fluids from a subsurface reservoir;

an inner production casing in communication with the wellhead, wherein the wellhead is operable to supply a cooling fluid through an annulus formed between the production tubing and the inner production casing while producing fluids through the production casing, and wherein the cooling fluid is supplied to a mixing zone that is in fluid communication with the subsurface reservoir;

an outer production casing in communication with the wellhead and surrounding the inner production casing; and an insulating layer disposed within a second annulus formed between the inner production casing and the outer production casing.

19. The system of claim 18, wherein the insulating layer includes gelled brine, nitrogen, or other insulating fluid or material.

20. The system of claim 18, wherein a portion of the production tubing includes insulated tubing.

* * * * *